United States Patent [19]

Ryunoshin

[11] 4,091,470

[45] May 30, 1978

[54] COLLAPSIBLE HELMET

[76] Inventor: Takemi Ryunoshin, No. 3233-114, Haraichi, Ageo-shi, Saitama-ken, Japan

[21] Appl. No.: 764,955

[22] Filed: Feb. 2, 1977

[30] Foreign Application Priority Data

Dec. 29, 1976 Japan ..... 51-158746

[51] Int. Cl.[2] ..... A42B 1/06

[52] U.S. Cl. ..... 2/410

[58] Field of Search ..... 2/410–416, 2/425

[56] References Cited

U.S. PATENT DOCUMENTS 3,514,787 6/1970 Kennedy ..... 2/410

3,991,422 11/1976 Saotome ..... 2/410

FOREIGN PATENT DOCUMENTS 1,053,195 3/1959 Germany ..... 2/410

*Primary Examiner*—Alfred R. Guest

*Attorney, Agent, or Firm*—McGlew and Tuttle

[57] ABSTRACT

A collapsible helmet is composed of several inwardly curved fan-shape sections which are divided into an equal number of parts at the top of the helmet body. The helmet can be folded into a nested position so as to assume the size of one of the sections so as to be convenient for carrying or storage. In the expanded position the helmet is able to absorb an impact imparted to the helmet, effectively.

9 Claims, 14 Drawing Figures

COLLAPSIBLE HELMET

BACKGROUND OF THE INVENTION

This invention relates to a collapsible helmet for guarding a wearer's head from an impact accidentally given thereto, and which is convenient for carrying or storage.

Heretofore, almost all the known helmets are integrally made of a unitary or one piece of metallic or plastic material. However, such conventional helmets are inconvenient in that they are too bulky to be carried or stored.

Furthermore, such conventional helmets protects the wearer's head from any impact accidentally given thereto only by virtue of the solidarity of the material thereof. As a result, the conventional helmets can not completely protect the wearer's head from the impact, in those instances where the impact on the helmet is greater than the solidarity of the helmet material.

This invention is intended to overcome the above-mentioned disadvantage while providing a helmet which can be conveniently carried and/or stored and which is capable of effectively protecting a wearer's head from impact.

OBJECTS

An object of this invention is to provide a collapsible helmet which can be simply assembled and folded compactly enough to carry or store.

Another object of this invention is to provide a collapsable helmet which can protect a wearer's head from impact by distributing the impact forces throughout the body of the helmet.

Another object of this invention is to provide a collapsable helmet which can be developed or folded by movement of one of the sections.

Another object of this invention is to provide a collapsable helmet which has a cap-shaped harness and a chin strap to fit the helmet to wearer's head which can be readily removed so as not to hinder the fractions folding of the respective section.

Other objects of this invention will be understood by the description of the the embodiments and claims.

BRIEF SUMMARY OF INVENTION

To achieve above-mentioned objects, the helmet comprised several inwardly curved fan-shape sections which constitute the body of the helmet at the unfolded A, first and second fixing means are provided on both sides of the fan-shape section to secure the sections in the assembling condition. A restraining means is provided on the top of the helmet body to restrain the section in the expanded or folding positions and a cap-shape harness and chin strap fits the helmet to wearer's head, and which harness can be taken out and lumped together not to hinder the fractions sections in folding.

Thereby, the helmet according to this invention, can be readily folded into a size comparable to that of one of the sections.

This invention will be illustrated in detail by way of examples in the accompanying drawings, in which:

IN THE DRAWINGS

PREFERRED EMBODIMENT OF THE INVENTION

Figure 1:
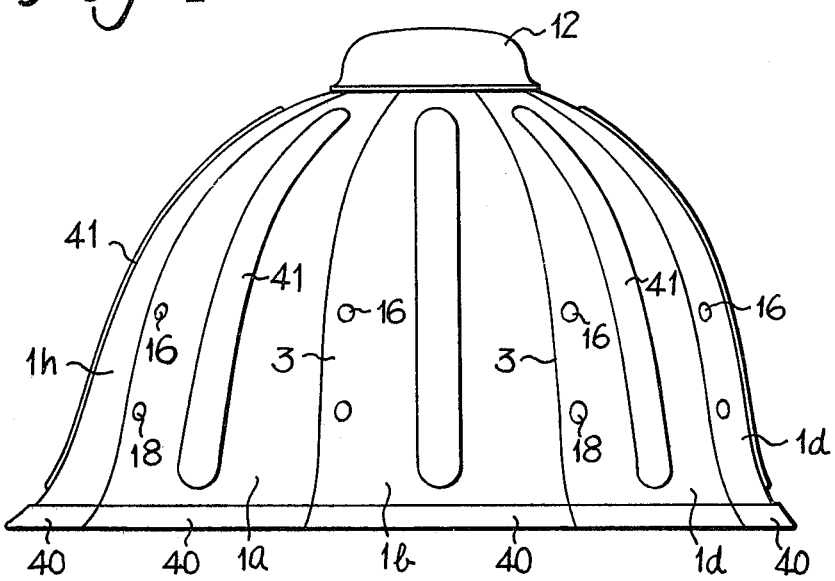
FIG. 1 is a side elevational view of the first embodiment of this invention.
Figure 2:
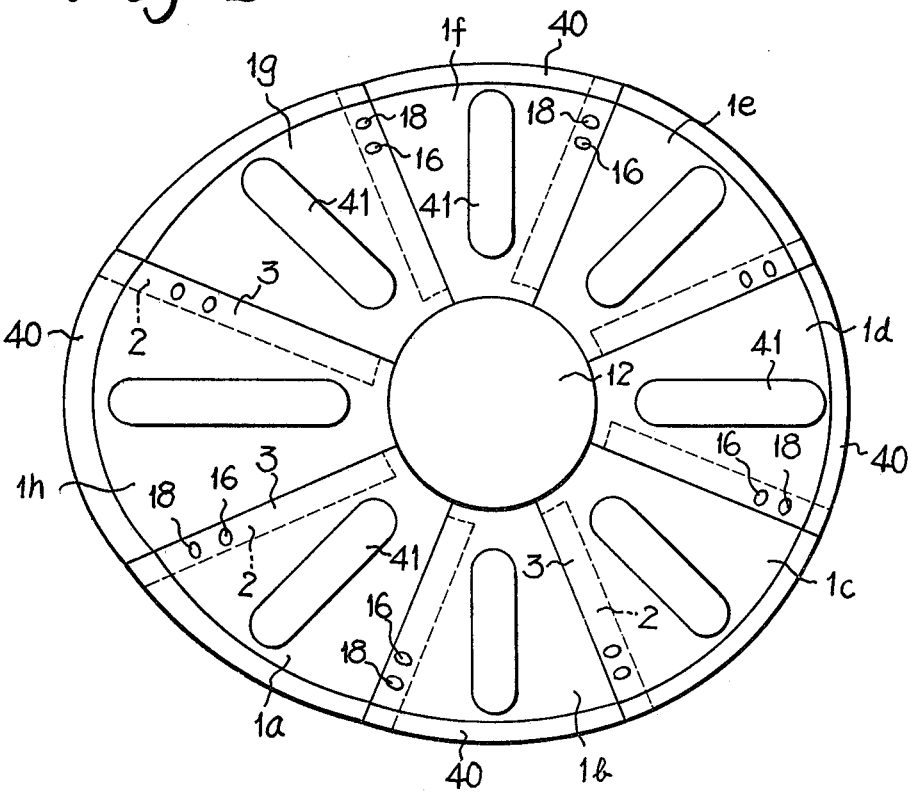
FIG. 2 is a plan view of FIG. 1.
Figure 3:
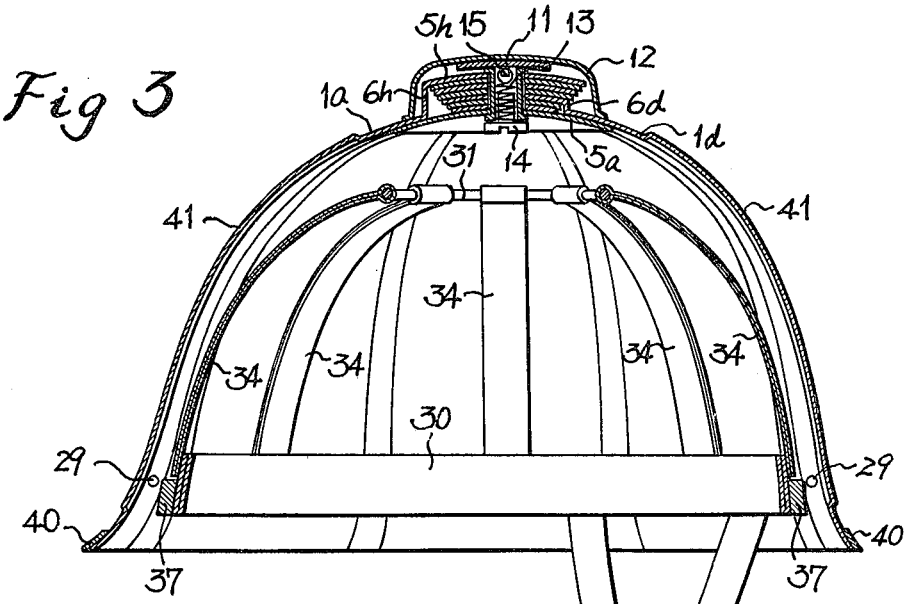
FIG. 3 is a longitudinal-sectional view taken along the mid section of FIG. 2.

Referring now to drawings, particularly to FIGS. 1, 2, the body of helmet is composed of eight pieces or sections 1 of generally equal shape. Each section is provided with an inner and outer lapping joints 2, 3 on both sides thereof. The lapping joints 2 are inwardly on the right sides of the fan-shape sections 1 to be overlaped with the outer lapping joints 3 provided on the left sides of the fan-shape sections 1*a*–1*h*–*1*.

Figure 5:
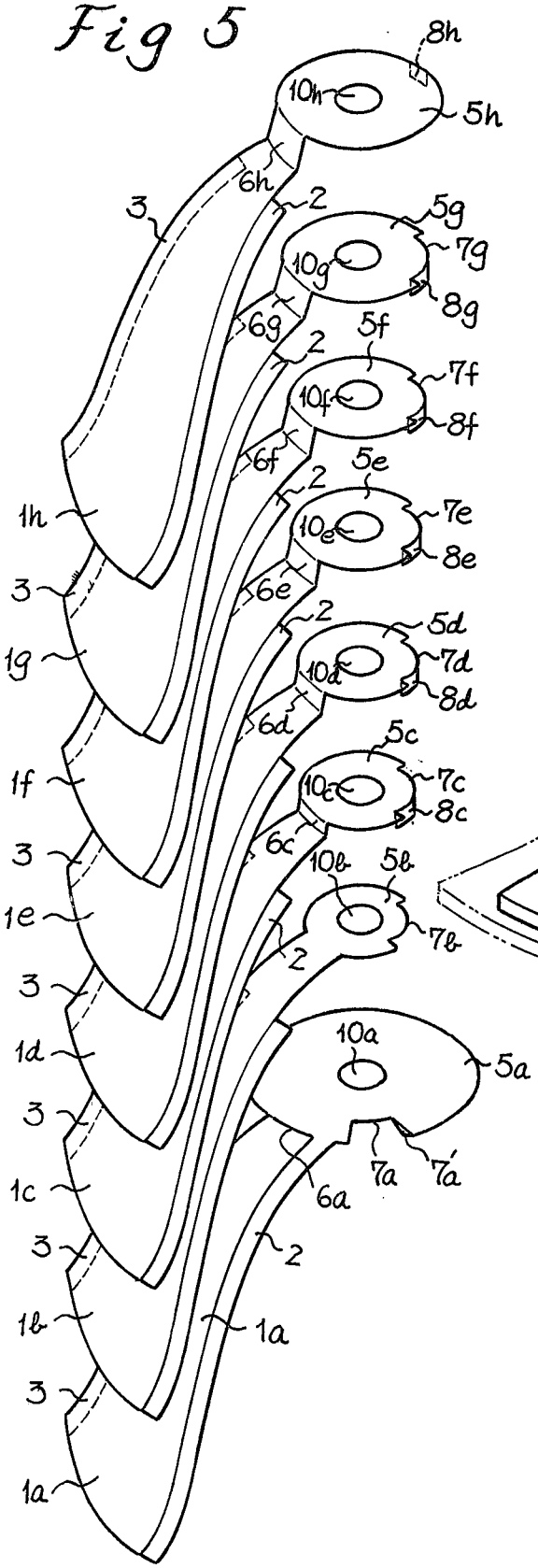
FIG. 5 is an exploded view of the respective section.

As shown in FIG. 5 on, each fan-shape 1*a* to 1*h* 1 is there is formed a stepped up circular plate 5*a* to 5*h*. The circular plate 5*a* of first fan-shaped section 1*a* downwardly stepped at 6*a*, and has the largest diameter in the all circular plates 5*a*–5*h* of the respective fan-shape sections 1*a*–1hr; and it is provided a cut 7*a* on the circumference thereof. One side edge of the cutout 7*a* is bent upwardly to form a stopper 7*a'* for engaging to right side edge of second fan-shape section 1*b*. The circular plate 5*b* of the second section 1*b* has the smallest diameter in the all circular plates 5 and provided a cutout 7*b* on the circumference thereof. The circular plate 5*b* is directly provided on the rivet of the fraction 1*b* is mounts on the circular plate 5*a* of the first section 1*a*. Circular plates 5*c* to 5*g* which are respectively provided on on plate 5*b*, are upwardly stepped as at 6*c* to 6*g* respectively and whose respective diameters are progressively larger than the preceeding adjoining circular plate 5. Each plate 5*c* to 5*g* is provided cutouts 7*c* to 7*g* and a claw 8*c* to 8*g* on the circumferences thereof. The circular plate 5*h* is provided with a larger diameter than the diameter of the seventh plate 5*g* and has a claw 8*h* on the circumference thereof.

Figure 9:
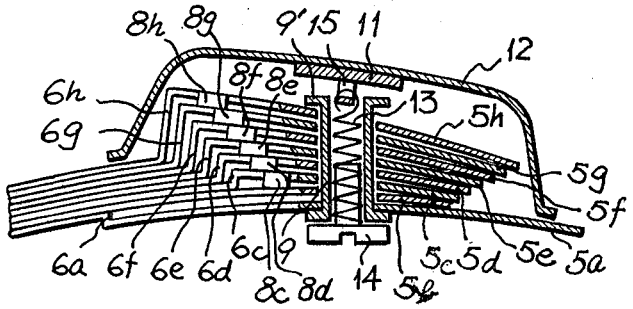
FIG. 9 is a same view as FIG. 8 but showing the same in a folded condition.
Figure 10:
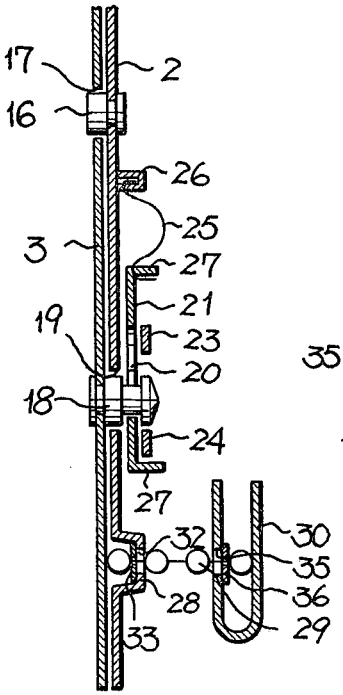
FIG. 10 is an enlarged fragmentary sectional view showing the first and second restraining means.
Figure 12:
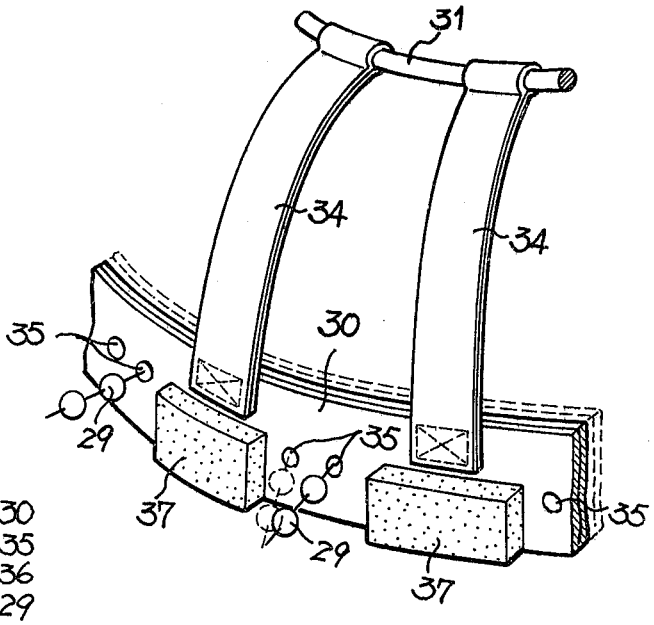
FIG. 12 is a fragmentary perspective illustration showing a cap-shape liner harness and chin strap.
Figure 11:
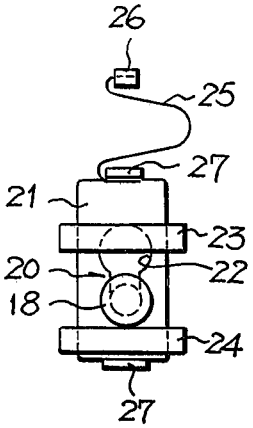
FIG. 11 is an enlarged front elevational view of a sliding plate of the second fixing means.

As shown in FIG. 9, the upward steps 6*c* to 6*h* provided between the sections 1*c* to 1*h* and the respective circular plates 5*c* to 5*h* are provided to be gradually higher than the adjoining preceeding member, namely, the step 6*c* of the section 1*c* is the lowest and the step 6*h* of the section 1*h* is the highest.

Figure 6:
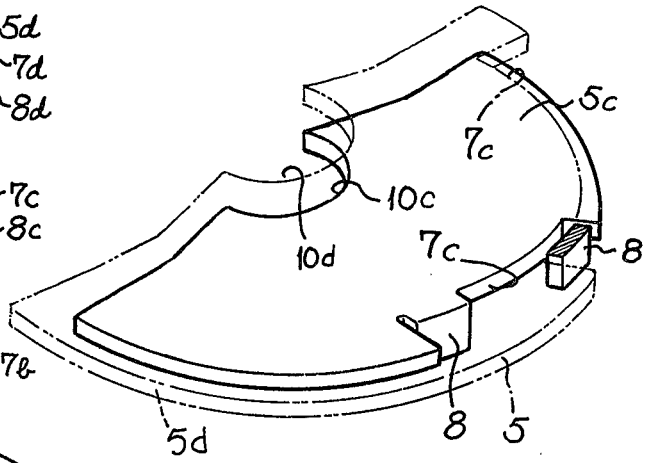
FIG. 6 is a fragmentary enlarged perspective view showing the engagement of the circular rivet plates.
Figure 7:
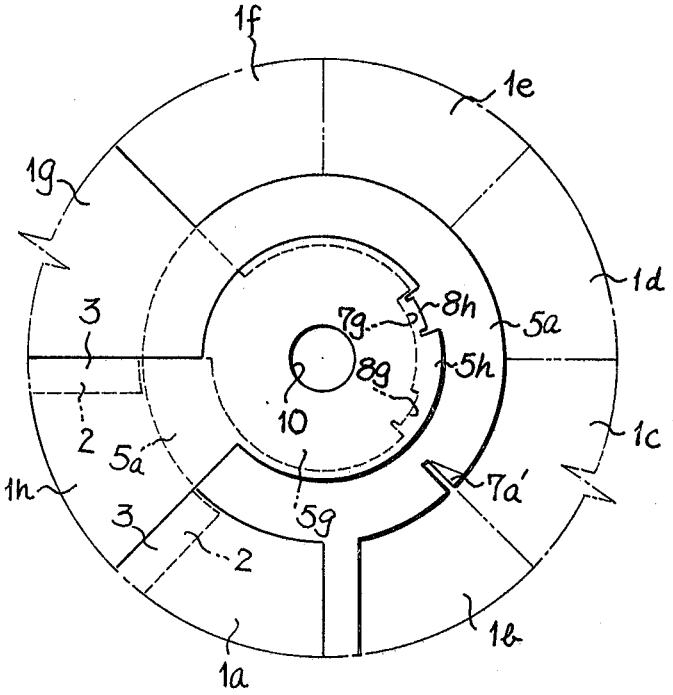
FIG. 7 is an enlarged fragmentary plan view.

As shown in FIGS. 6 and 7, the right side edge 7*b* of the second section 1*b* engages to the stopper 7*a'* of the circular plate 5*a* and the cut-outs 7*b* to 7*g* and claws 8*c* to 8*h* respectively provided on the circumferences of the plates 5*b* to 5*h* are respectively engage so as to be able to develop the section 1*a* to oh in a counterclockwise movement of the eighth sections 1*a*–1*h* semi-automatically and to have the center line of each adjoining sections 1 gaps at least 45° to exactly form the helmet body.

Figure 8:
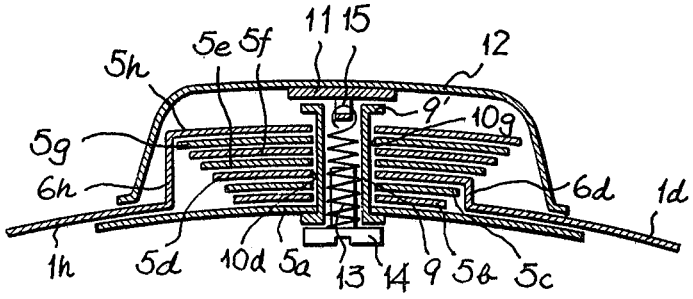
FIG. 8 is a fragmentary sectional view showing the restraining means in the developed condition.

As shown in FIGS. 8 and 9, a sleeve 9 is upwardly extended through an aperture 10*a* provided in the circular plate 5*a* of the first section 1*a*. The sleeve 9 extends also through apertures 10*b* to 10*h* which are provided on the respective circular plates 5*b* to 5*h*, to constitute a pivot of development for the sections 1*a*–1*h*. A flange 9' extends outwardly to define the top of the sleeve 9 and to prevent the plates 5*a*–5*h* from loosing. The upper end of the sleeve 9 is faced to a washer 11 provided on a cap 12 which is installed on the helmet body to cover the circular plates 5*a*–5*h*. A coil spring 13 is disposed through the sleeve 9 and lower end thereof is engaged to threads of a screw 14 extending upwardly in sleeve 9 and upper end of spring 13 is engaged to a projection 15 provided on the cap 12. The spring 13 exerts a sufficient downward tension for the cap 12 to be able to adequately bind the circular plates 5*b* to 5*h* arranged between the cap 12 and the circular plate 5*a*. The tension for the circular plates can be adjusted by screw 14.

Figure 4:
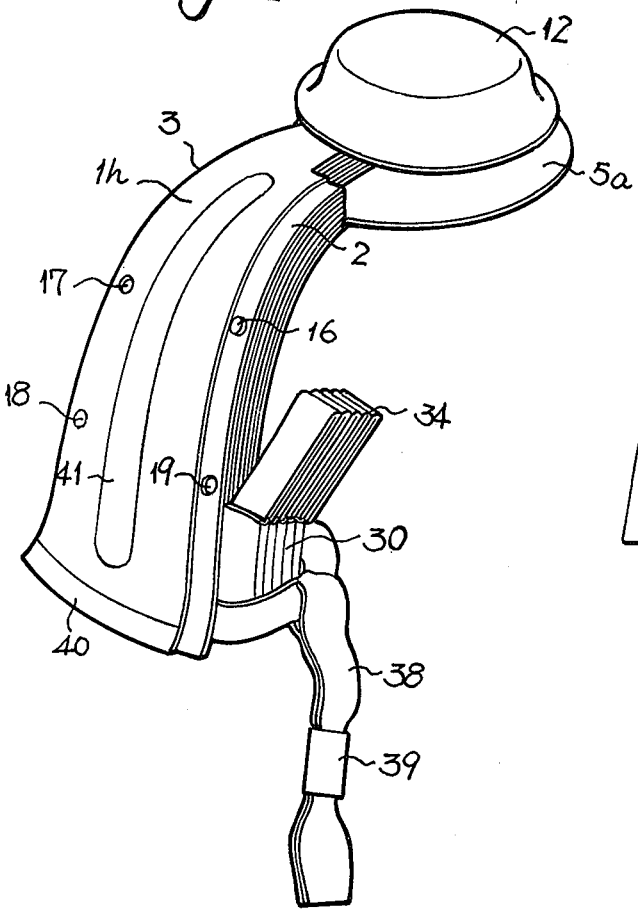
FIG. 4 is a perspective view of the the helmet of FIG. 1 in a folded condition.
Figure 4:
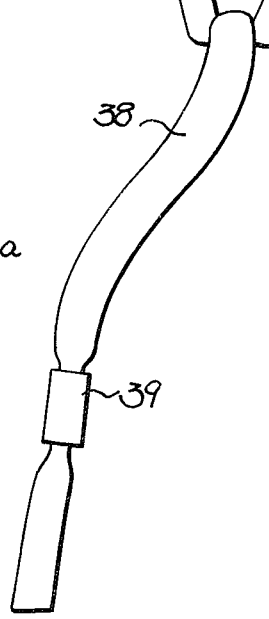

As shown in FIG. 4, projections 16 are provided on the outer surface of the inner lapping joints 2 of section 1 and apertures 17 are formed on the lapping joints 3 for receiving projections 16 of the inner lapping joints 2 in the developed position of the helmet. The projections 16 are engaged to the apertures 17 provided adjoining section to interfere the movement of the sections 1 to circumferential direction.

There are provided projections 18 on the inner surfaces of the outer lapping joints 3. The projections 18 are respectively cone shaped at the top thereof. On the inner lapping joints 2, there are provided apertures 19 receiving projections 18 of the outer lapping joints 3. A sliding plates 21 with key holes 20 are installed on the inner surface of the inner lapping joints 2. The key-holes 20 of the sliding plates 21 have the enlarged circular-hole portion 22, on the upper portions thereof so as to receive projections 18. On the lower portions of the key-holes 20, there are provided narrow upward-opened elongated ellipses to engage the groove of the projections 18. Each sliding plate 21, made of spring steel is movablly installed on the inner surface of the inner lapping joint 2 by fitting means 23, 24 and constantly pulled or biased upwardly by a spring 25 which is provided on the inner surface of the inner lapping joint 2 and which is fixed at element 26. At the upper and lower ends of the sliding plates are bent to form stoppers 27 which can be used for manually pulling down the sliding plates 21 to align the enlarged circular-portion 22 with the projections 18. The projections 18 are respectively engaged to the key-holes 20 with the groove thereof to interfere outward loosing of fixing.

On the lower portion of the inner lapping joints 2, there are provided dents 28 which protrudes inwardly. Outer ends of chains 29, for streching a lower ring 30 of a collapsible harness, engage to the dents 28 through apertures 32 provided on the dents 28, by washers 33. An upper cloth ring 31 of the cap-shape harness is connected to the lower ring 30 with eight pieces of cloth belts 34. The lower ring 30 is formed with eight pairs of apertures 35 to connect with the inner ends of the chains 29. The inner ends of the chains 29 is adjustablly connected to the lower ring 31 through the apertures 35 by washers 36 to render the diameter of the lower ring 31. The lower ring 31 adjustable has spaced therearound several shock absorbing members 37 on the outer surface thereof. There is also provided a chin strap 38 on the lower ring 30 that can be adjusted for girdling by a member 39.

On the lower end of each fan-shape section 1, there are provided a shock absorber 40 and the outer surface of the sections 1 are provided ribs 41 for reinforcing the sections 1.

In assembling, the eighth fraction 1*h* is moved conterclockwise, then the remaining fractions 1*g* to 1*b* are automatically developed by order with engagement of the cuts 7 and claws 8. The development of each fan-shape section 1 in order develops the helmet . Then, each claw 8 of the circular plate 5 is engaging to the cut-out 7 of the adjoining lower circular plate.

Each projection 16 of the inner lapping joint 2 engages to aperture 17 of the adjoining outer lapping joint 3 to limit the movement of the section in a circumferential direction.

Manually pulling down the sliding plate 21 aligns the enlarged circular-hole 22 of the key-hole 20 to the aperture 19 of the inner lapping joint 2 and, each projection 18 of the outer lapping joint 3 runs through the circular-hole portion 22. Release of, the sliding plate 21 causes spring 25 shift the side plate upwardly to engage the lower portion of the key-hole 20 to the bezel or groove of the projection 18 to limit outward loosing of the each fraction.

Cap 12 is pulled downward by the coil spring to restrain the circular plates 5 and the maintains the sections in assembled condition.

On folding, releasing the fixing means from fixing condition, each fan-shape fraction 1 is nested or folded to be the size of one of the section 1. Then the cap 12 restrains the section 1 from developing, as shown in FIG. 9. And the upper and lower cloth ring of the cap-shape harness and chin strap can be taken out and lumped folded together not so as to hinder the sections from folding.

Figure 13:
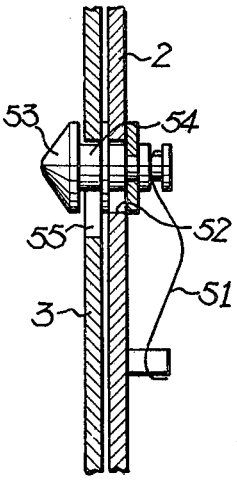
FIG. 13 is an enlarged fragmentary sectional view showing the similar portion as FIG. 10 of the second embodiment of this invention.

Showing in FIG. 13 is another embodiment of this invention. In this embodiment the fixing means to interfere outward loosing of the fractions, comprises an axis 54 slidablly provided on the inner surface of the inner lapping joints 2 and which is protruded outwardly through elongated slots 52 formed on the inner surface of the inner lapping joints 2. The axis 54 is constantly pulled upwardly by a spring 51 installed on the inner surface of the inner lapping joint 2 and is provided with cone-shape head 53 whose bottom diameter is larger than the diameter of the axis 54, on the outer end thereof.

An aperture 55 formed on the outer lapping joint 3 is has a larger diameter than the diameter of the cone-shape head 53 and is positioned at a slightly lower position to read than the head 53.

On engaging, the tapered side surface of the head 53 is touched to the upper edge of the aperture 55 and is pushed down to the position where is adapts to the aperture 55 and extends therethrough. And after the head 53 runs through the aperture 55, the axis is pulled upwardly, and the head 53 is engaged to the apertur 55 to limit outward loosing of the segments.

Figure 14:
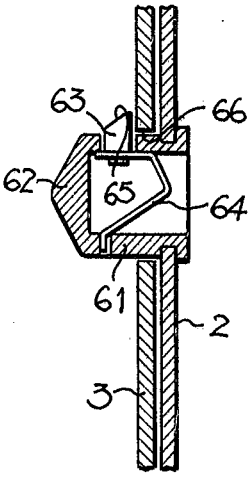
FIG. 14 is an enlarged fragmentary sectional view showing the similar portion as FIG. 10 of the third embodiment of this invention.

FIG. 14 is further embodiment of this invention. A sleeve 61 which is provided with a cone-shape head 62, is secured on the inner lapping joint 2 and is protruded outward. On the upper portion of the sleeve 61 adjacent to the head 62, there is provided with a projection 63 supported and pushed upwardly by a spring 64 provided on the inner portion of the sleeve 61. On the outer surface of the projection 63, there are formed tapered surface 65. An aperture 66 is formed on the outer lapping joint 3 whose diameter is provided to be slightly larger than the diameter of the sleeve 61 and is positioned to be adapted to the sleeve 61.

On engaging, the tapered surface 65 of the projection 63 is touched to the edge of the aperture 66 and is pulled down to be able to the sleeve 61 run through the aperture 66. After running through the aperture 66, the projection 63 is pushed upwardly to engage to interfere outward loosing of the fraction 1.

The helmet of this invention constituted as above can be simply developed and folded compactly enough to be carried or stored.

While specific embodiments of this invention have been shown and described in detail to illustrate the application of the principles of the invention, it will be understood that the invention may be embodied otherwise without departing from such principles.

What I claim is:

1. A collapsible helmet adapted to fold between a collapsed nested position and an unfolded developed position comprising a plurality of fan-shaped segments having a circular plate connected to the upper end of each of said segments which are adapted to be superposed one on the other, each of said plates having an aligned aperture therein, a pivot means for pivotally connecting said plates in superposed relationship wherein said segments can pivot between a nested position and developed position, said pivot means comprising a sleeve extending through said aligned apertures, a spring disposed in said sleeve, a cap member disposed over said stacked circular plates, said spring having one end thereof secured to said cap member, an adjusting member extending into said sleeve, said spring having its other end adustably secured to said adjusting member whereby the tension of said spring can be adusted, means for successively training said segments upon unfolding from the nested position, said training means comprises a cut-out portion formed about a peripheral portion of plates, and a complementary claw member, said cut-out portion and complementary claw member being arranged whereby the claw member of one plate engages with the cut-out portion of the next adjacent plate, each of said segments having complementary first and second fastening means disposed along the opposed edge portion which are arranged to be disposed in overlapping relationship in the developed position of said segments, said first and second fastening means each comprises an aperture disposed along one edge of a segment and a complementary projection oppositely disposed along the other longitudinal edge of said segment whereby the aperture of one segmet is adapted to receive a complementary projection of the next adjacent segment in the unfolded position of said segment, and its complementary projection and aperture of said second fastening means being relatively moveable to one another to and having complementary latching means to provide an interlock therebetween, said first fastening means being aperture to restrict circumferential displacement of said segments relative to one another, and said second fastening means being operative to restrict outward displacement of the adjacent segments in the developed position of said helment.

2. A collapsible helmet as defined in claim 1 wherein the sleeve has a laterally extended portion at the top and bottom thereof so that said circular plates cannot be separated therefrom.

3. A collapsible helmet as defined in claim 2 wherein said sleeve is longer than the thickness of all of the stacked plates.

4. A collapsible helmet as defined in claim 1 wherein the cut-out of the lower plate has an upwardly bent edge portion to define a stop to limit the circumferential movement of said segments, and the next lower circular plate has a cut-out and the uppermost plate a claw, and the plates between said next lower plate and uppermost plate have both a cut-out and a claw whereby the cut-out and claw of next adjacent section co-act to sequentially train the respective segment in unfolding between a nested and developed positions.

5. A collapsible helmet as defined in claim 1 wherein each segment has a laterally stepped longitudinal edge portion to define the inner lapped portion, said inner lapped portion having the projection of said first fastening means thereon, and the aperture of said second fastening means, said second fastening means including a slideable plate having a key-hole for latching the projection of said second fastening means.

6. A collapsible helmet having a plurality of inwardly curved fan-shaped segments pivotally secured at the top thereof wherein the improvement comprises: a plurality of segments having plate portions superposed one on the other, a cap disposed over said superposed plates, said plates being provided with a central aperture disposed in alignment, a sleeve extending through said aligned apertures, a coil spring being disposed in said sleeve, one end of said spring being secured to the inner surface of said cap, a screw extending upwardly into said sleeve, said spring having its other end adjustably connected to said screw, and said plates having complementary cut-out portions and claws disposed about the circumference thereof, whereby the claw of one plate engages the cut-out portion of the next adjacent plate, whereby said claws and cut-out portions cooperate to effect the successive training of the segments between a folded and developed position by effecting the movement of one segment, and a first and second fastening means, said fastening means comprising complementary apertures and projections disposed along the longitudinal edges of the respective segments, and said fastening means including a sliding plate for latching onto the projection of said second fastening means, and a spring for biasing said sliding plate in the latch position thereof, said sliding plate being located on the inner surface of the associated segment, and a collapsible harness installed in said helmet, a chain for securing said harness to said segments, whereby said harness can be readily folded in the nested position of said segments.

7. A collapsible helmet as defined in claim 6 wherein the lower most circular plate is formed with a cut-out, one edge of said cut-out being upwardly bent to form a stop to limit the movement of the said segments, the next circular plate having formed about a peripheral portion thereof a cut-out, and the uppermost circular plate having a claw located on the periphery thereof, and the other intermediate circular plates each having a cut-out portion and a claw disposed about the periphery thereof, the cut-out portions and associated claws of adjacent plate providing inter-engagement therebetween so as to prevent the successive training of the respective segments in moving from a nested and unnested position.

8. A collapsible helmet as defined in claim 7 wherein the second fastening means includes a projection extending inwardly from the inner surface of the outer overlapping portion of said segments, a complementary aperture formed on the inner lapping edge portion of an adjacent segment, and a sliding plate provided on the inner surface of the inner lapping edge portion of said segment, said sliding plate having a key-hole shaped aperture formed thereon, said key-hole shaped aperture being adapted to latch said projection in a locking and unlocking position, and a spring for normally biasing said sliding plate in the latched position thereof.

9. A collapsible helmet as defined in claim 8 wherein said collapsible harness includes an upper and lower ring member, a plurality of circumferentially spaced belts of flexible material interconnecting said upper an lower ring, and shock absorbing means circumferentially spaced about the lower ring member.

* * * * *